US006286172B1

(12) United States Patent
Castagnoli

(10) Patent No.: US 6,286,172 B1
(45) Date of Patent: Sep. 11, 2001

(54) PORTABLE INFLATABLE DUCT CLEANING APPARATUS

(76) Inventor: Thomas A. Castagnoli, 1137 Mary La., Naperville, IL (US) 60540

( * ) Notice: Subject to any disclaimer, the term of this patent is extended or adjusted under 35 U.S.C. 154(b) by 0 days.

(21) Appl. No.: 09/265,523

(22) Filed: Mar. 8, 1999

(51) Int. Cl.[7] ..... B08B 9/027

(52) U.S. Cl. ..... 15/104.19; 15/104.16

(58) Field of Search ..... 15/104.05, 104.16, 15/104.19, 104.31, 104.165, 104.2, 104.066, 104.068, 212, 165; 604/96.01, 97.01, 99.01, 99.02, 99.03, 103.05, 104, 528; 606/191

(56) References Cited

U.S. PATENT DOCUMENTS

| | | | | |
|---|---|---|---|---|
| 614,749 | * | 11/1898 | Pallas | 15/104.066 |
| 856,063 | * | 6/1907 | Howell | 15/104.16 |
| 1,088,459 | * | 2/1914 | Shade | 15/104.31 |
| 1,384,305 | * | 7/1921 | Crotto | 15/104.05 |
| 1,510,212 | * | 9/1924 | Du Bois | 15/104.31 |
| 1,513,228 | * | 10/1924 | Crotto | 15/104.16 |
| 1,848,269 | * | 3/1932 | Petersen | 15/104.31 |
| 2,642,602 | * | 6/1953 | Kelly | 15/104.16 |
| 3,224,734 | * | 12/1965 | Hill | 15/104.16 |
| 3,398,417 | * | 8/1968 | Erwin | 15/104.19 |
| 4,292,974 | * | 10/1981 | Fogarty et al. | 604/97.01 |
| 5,102,415 | * | 4/1992 | Guenther et al. | 604/103.05 |
| 5,285,806 | * | 2/1994 | Ortega | 15/104.2 |

FOREIGN PATENT DOCUMENTS

| | | | | |
|---|---|---|---|---|
| 1845 | * | 2/1878 | (DE) | 15/104.16 |

* cited by examiner

*Primary Examiner*—Robert J. Warden, Sr.
*Assistant Examiner*—Theresa T. Snider
(74) *Attorney, Agent, or Firm*—Patnaude & Videbeck

(57) ABSTRACT

A portable inflatable heating, ventilating and air conditioning duct apparatus includes a bladder made of resilient material for expansion and contraction. The bladder has a small opening for the movement of air in and out of the bladder. An elongate flexible hose is connected at one end with the small opening on the bladder. An air pump is positioned at the opposing end of the elongate flexible hose for supplying air under low positive pressure to the bladder for expansion of the bladder. A manually operated valve is positioned between the air pump and the bladder for preventing the escape of air from the bladder, unless same is desired. The apparatus further includes direction stabilizing apparatus for allowing the flexible hose to push the bladder through a segment of the HVAC duct in which the apparatus is positioned.

9 Claims, 3 Drawing Sheets

PORTABLE INFLATABLE DUCT CLEANING APPARATUS

This invention relates generally to heating and ventilating air duct cleaning apparatus, and more particularly, to a low pressure duct cleaning apparatus including a bladder that when inflated contacts the interior surface of heating and ventilating (HVAC) ducts to wipe clean same as the bladder is moved along the length of the duct.

BACKGROUND OF THE INVENTION

Presently, complex duct cleaning systems include vacuum pressurized pneumatic lines, pressurized fluid spraying lines and pneumatically operated whirling brushes. The fluid or air under pressure and the whirling brushes loosen dust, dirt and grime, and a vacuum line is supposed to pick up the residue. So-called advances in these systems have included making them more complex with additional optional equipment.

German Patent 162130 discloses a flue cleaner having a rectangular metal frame with an expansible rubber outer surface for scraping against the rectangular sides of a flue.

U.S. Pat. No. 856,063 discloses an expansible pipe cleaner having a rubber bladder that may be flattened and made to a larger diameter by screwing a nut along a central rod to expand the diameter of the bladder. The patent also discloses a ribbed outer surface for the bladder.

U.S. Pat. No. 5,285,806 discloses an inflation bag which when used with a retaining rod positioned diametrically across a pipe line in conjunction with a high pressure source of compressed gas will block a pipeline from fluid flow therethrough.

A need has developed for an improved simplified apparatus for cleaning heating, ventilating and air conditioning ducts.

Additionally, a need has developed for providing an improved simplified apparatus for cleaning ducts which is capable of cleaning both rectangular and circular HVAC ducts.

SUMMARY OF THE INVENTION

The invention is directed to a portable inflatable HVAC duct cleaning apparatus comprising a bladder made of resilient material for expanding and contracting its size. The bladder has a small opening for moving air in and out thereof. An elongate flexible hose is positioned in communication with the small opening on the bladder. An air pump is positioned in fluid communication at an opposing end of the elongate flexible hose for supplying air under low positive pressure to the bladder when expanding the bladder. Manually operable valve means are positioned between the air pump means and the bladder for preventing the escape of air from the bladder as desired. Direction stabilizing means are included and are positioned in communication with the hose for aiding and positioning the bladder a substantial distance from any opening in any HVAC duct in which the apparatus is positioned.

The invention is further directed to a method of cleaning a segment of an HVAC duct which comprises the following steps:

1) depositing cleaning fluid on the exterior of a resilient bladder;
2) positioning the resilient bladder inside an HVAC duct;
3) pushing the bladder and hose attachment into the HVAC duct;

4) inflating the bladder until its exterior substantially completely fills a cross section of the HVAC duct;
5) pulling on the hose to move the bladder along a segment of the duct loosening dirt and debris from the interior of that segment;
6) deflating the bladder, and cleaning the exterior of the resilient bladder.

BRIEF DESCRIPTION OF THE DRAWINGS

The features of the present invention which are believed to be novel are set forth with particularity in the attached claims. The invention may best be understood by reference to the following description taken in conjunction with the accompanying drawings in which like numerals refer to like parts, and in which:

DETAILED DESCRIPTION OF THE PREFERRED EMBODIMENT

Figure 1:
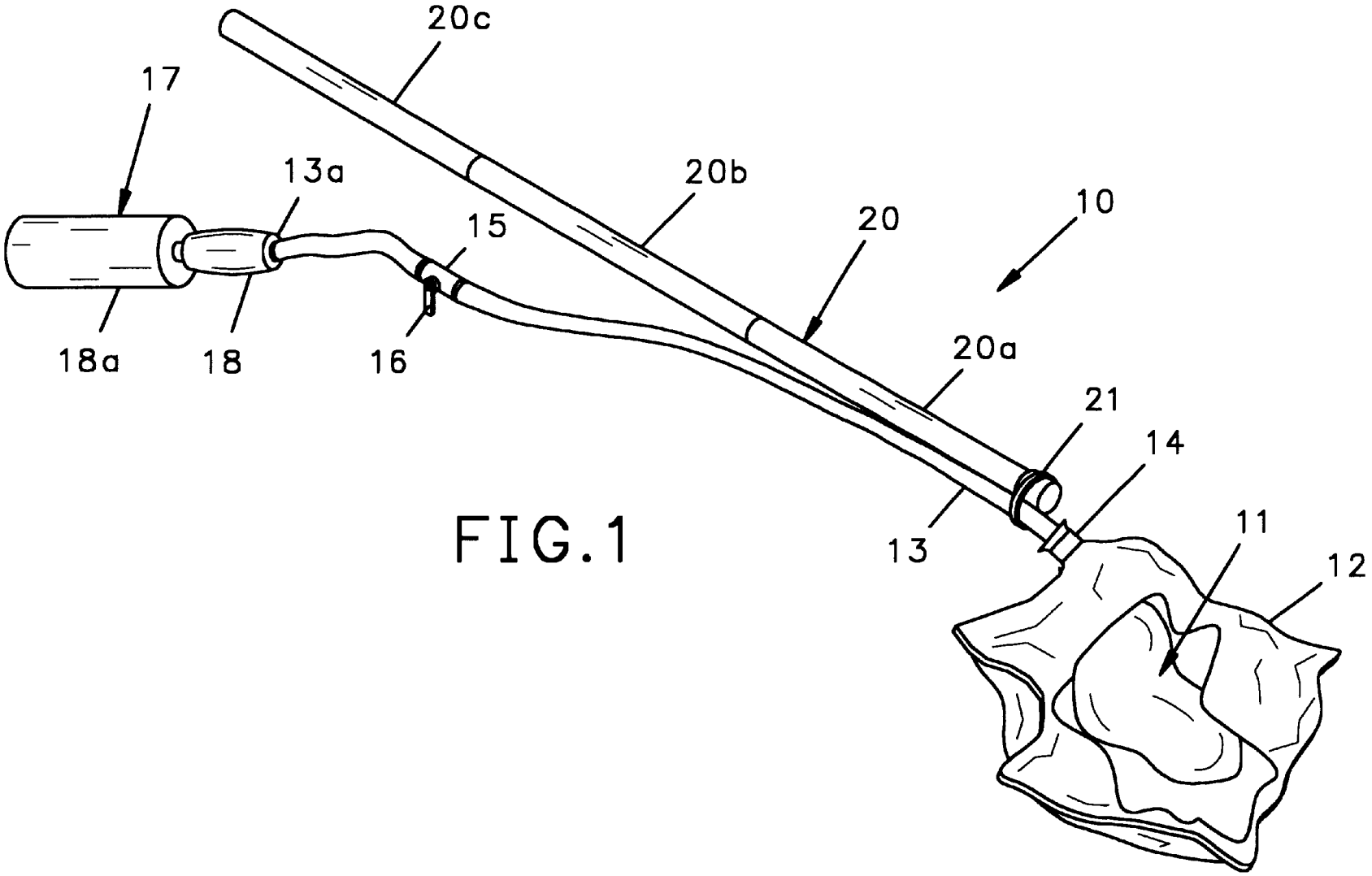
FIG. 1 is a perspective view, with portions cut away, of a portable duct cleaning apparatus constructed in accordance with the present invention.

Referring to FIG. 1, a duct cleaning apparatus, generally indicated at 10, constructed in accordance with the present invention, includes an expansible bladder 11 having a cleaning cloth or other exterior cover 12, either mounted thereover or as an exterior surface of the bladder 11, removably affixed to a pliable hose 13. A selectably releasable collar 14 is positioned over the open end, the cover 12, and the hose 13 and another collar 14a is positioned over the open end of the bladder 11. Hose 13 includes adjacent a distal end 13*a* thereof a shut off valve 15 which is hand operable by lever 16 between open and closed positions and the rigid tube 22. The distal end 13*a* of hose 13 has connected thereto in the preferred embodiment a hand operable air pump 17, sold by Unique Industries, Inc. as model 4920 which includes a manually holdable handle 18 and a reciprocable pump lever 18*a*. Adjacent the collar 14, a multi-piece extensible positioning rod, generally indicated at 20, is connected to hose 13 by means of a releasable collar 21. In this embodiment, extensible rod 20 includes segments 20*a*, 20*b* and 20*c* in this embodiment which provide an adjustable means for placing the bladder 11 and the cover 12 in the distant portion of a long straight duct to be cleaned.

Figure 2:
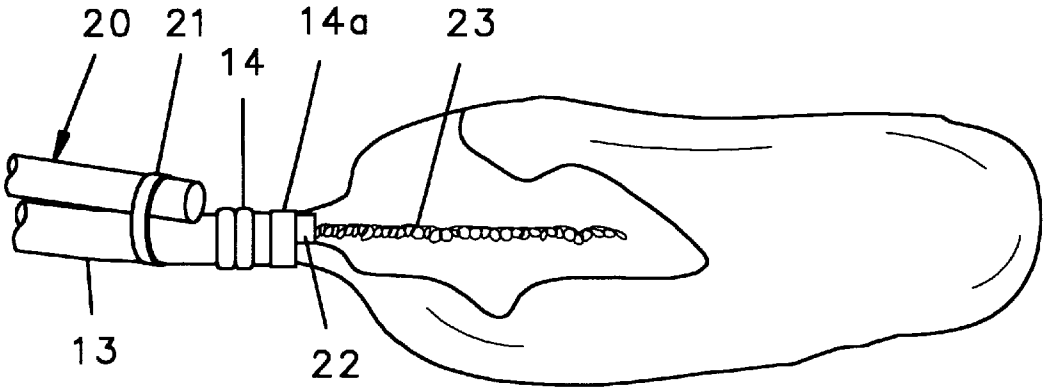
FIG. 2 is an enlarged fragmentary view of a bladder utilized in the present invention with portions cut away showing a wire coil extending therein for maintaining proper orientation of the bladder.

Referring to FIG. 2, an enlarged cutaway view of the joinder of the hose 13, bladder 11, and extensible rod 20 discloses that adjacent and through the area of the joinder of those pieces is positioned a wire coil 23 that provides directional stability to the forward portion of the duct cleaning apparatus to assure the bladder does not kink or fold backward as the apparatus is being pushed through an HVAC duct.

Figure 6:
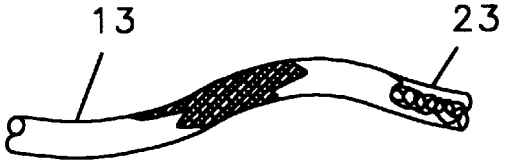
FIG. 6 is a fragmentary view with portions cut away for clarity of the air hose utilized in the present invention showing the wire coil positioned therein for additional strength.

Referring to FIG. 6, in the preferred embodiment of the invention, coiled wire or rod 23 extends through the length of hose 13 to provide additional directional stability for the hose 13 while allowing some resiliency thereto. Wire or rod coil 23 may be similar to a plumber's pipe cleaning rod. It should be noted that the wire or rod or coil 23 does not extend through the valve 15, thus allowing it to be opened and closed freely. The valve 15 is positioned close to the distal end 13*a* of hose 13 to limit the amount of the hose that is not reinforced. Both the extensible rod 20 and the stability to the hose 13 and coil 23 may be more than one piece, if necessary, to extend into the bladder. Extensible rod 20 and coil 23 may be used together or separately as needed.

Figure 3:
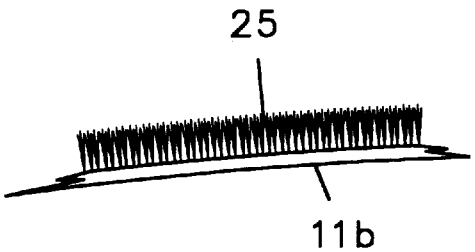
FIG. 3 is a fragmentary cross-sectional view of a bladder utilized in connection with the present invention showing a sponge type outer surface in connection therewith.
Figure 4:
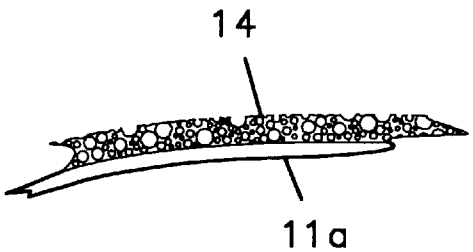
FIG. 4 is a fragmentary cross-sectional view of a bladder used in connection with the present invention showing a brush type exterior.
Figure 5:
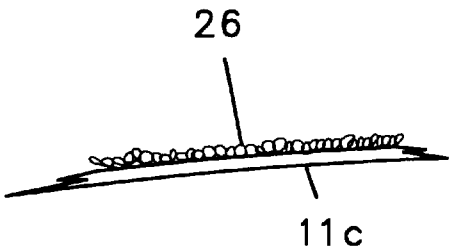
FIG. 5 is a fragmentary cross-sectional view of a bladder used in connection with the present invention showing a scrub pad type exterior positioned thereon.

Referring to FIGS. 1, 3, 4 and 5, several differing modifications to the bladder are shown having differing outside cleaning surfaces. Referring to FIG. 1, the bladder 11 has a cloth bag or cover 12 positioned thereover. The cloth cover 12 may be made of a cotton, burlap, terry cloth or other material that will provide a scrubbing surface for the outside of the bladder 11. Referring to FIGS. 3, 4 and 5, the bladder itself, shown at 11*a*, 11*b* and 11*c* has integrally formed on the outside thereof a structure suitable for use in scrubbing the inside of an HVAC duct. FIG. 3 discloses an open cell sponge exterior 24 which is bonded to the outside of the bladder 11*a*. FIG. 4 shows brush bristles 25 that extend outwardly from the bladder 11*b*. FIG. 5 shows plastic scrub brush type interwoven fibers 26 that are integrally formed to extend from the outside of bladder 11*c*. All of the differing scrub surfaces 12, 24, 25 and 26 retain and support cleaning liquids (not shown) used in connection therewith for scrubbing the inside of HVAC duct surfaces. It should be noted that sponge 24 is expansible with the bladder 11*a*, as are the spaces between the bristles 25 of the brush on bladder 11*b* and the plastic fibers 26 on bladder 11*c* to allow for expansion and contraction of the bladder as it is inflated to closely fit the inside surface of an HVAC duct.

In Operation

Referring to FIGS. 1–2, 7, 8 and 9, the duct cleaning apparatus of the invention is utilized to clean relatively small sections of duct work at intervals. By varying the length of the hose 13 and by extending the extensible rod 20, fairly long sections of duct work may be cleaned utilizing the apparatus 10 of the invention. As shown most clearly in FIG. 7, the duct work is cleaned by positioning the bladder into a duct 30 through an end opening, such as 31 or a removable grating (not shown) or side access port (not shown) of a duct.

Depending upon the length of the duct and whether any 45 degree elbows or corners are encountered, bladder 11 may be moved forwardly in the duct 30 through the opening 31 solely by means of the reinforced hose 13. This may be successfully accomplished by utilizing the metal coil 23 (FIG. 5) in hose 13 positioned so that it extends between the leading portion of hose 13 and the bladder 11 to keep the bladder from doubling back on itself or kinking that would prevent air from being moved into the bladder to expand it. It should be noted that in the embodiment shown in FIG. 7, prior to positioning the bladder 11 in the duct 30 through opening 31, the bladder 11 and the cleaning cloth 12 surrounding same may be dipped in a liquid cleaning solution which may be kept in a convenient bucket (not shown). If the hose 13 having the coil 23 positioned therein is not sufficiently directionally stable to push the bladder through the duct work 30 to its beginning cleaning position as shown in FIG. 7, the extensible rod 20 may be added to the forward end of the hose 13 at collar 21 to enable that forward end of the bladder to be pushed forwardly a sufficient length to be positioned properly as desired in duct 30.

After the bladder 11 is properly placed in the desired position in the duct work 30, the valve 15 is opened, pump handle 18 is grasped with one hand, and the reciprocating lever 18*a* is pumped with the user's other hand to provide air pressure through hose 13 to the bladder 11 to blow up that bladder so as to completely fill the cross section of the duct 30. This may be accomplished whether that duct is rectangular as shown at 30*a* in FIG. 8 or circular as shown at 30 in FIG. 9. After sufficient relatively low air pressure, preferably less than one additional atmosphere has been utilized by pump 17 to pump air through hose 13 into bladder 11, the bladder will fill the cross section of the duct 30 completely to press the wet wash cloth 12 against the inner surface of duct 30. Once the bladder applies this relatively low pressure to the wash cloth 12, the hose 13 and the bladder 11 with the wash cloth on the outside thereof are moved or dragged through the duct 30 in a direction toward the opening 31 a sufficient distance to collect a substantial amount of the dirt and grime from the inner wall of the duct 30.

The distance which the bladder 11 and cleaning cloth 12 are moved for each application of the cleaning apparatus 10 to the inside of the duct work is a judgment call of the user depending upon the dirt absorption power of the cleaning cloth 12 and the amount of dirt and debris on the inside surface of the duct 30. After the bladder 11 and cleaning cloth 12 are dragged or moved the requisite amount along the duct 30, the air valve 15 is opened to allow the bladder to constrict to provide for easy removal of the apparatus 10 from the duct 30 through the opening 31. The dirty cloth cover 12, either off of or remaining on the bladder 11, is then positioned in the cleaning bucket (not shown) and cleaned, as a mop would be cleaned until the dirt and grime is removed therefrom. Thereafter, the duct work cleaning apparatus 10 of the invention may be repositioned through opening 31 into duct 30 as described previously to either clean an adjacent portion of the duct work 30, or to apply the bladder 11 and cleaning cloth 12 to the same area previously cleaned to provide a second scrubbing of that same area, if necessary. By inflating the bladder 11 and cleaning cloth 12, repeatedly, as described, the entire duct work may be cleaned in sections without the need for using complex water pumps, electrically operated air compressors, motor operated turning brushes or the like.

Figure 7:
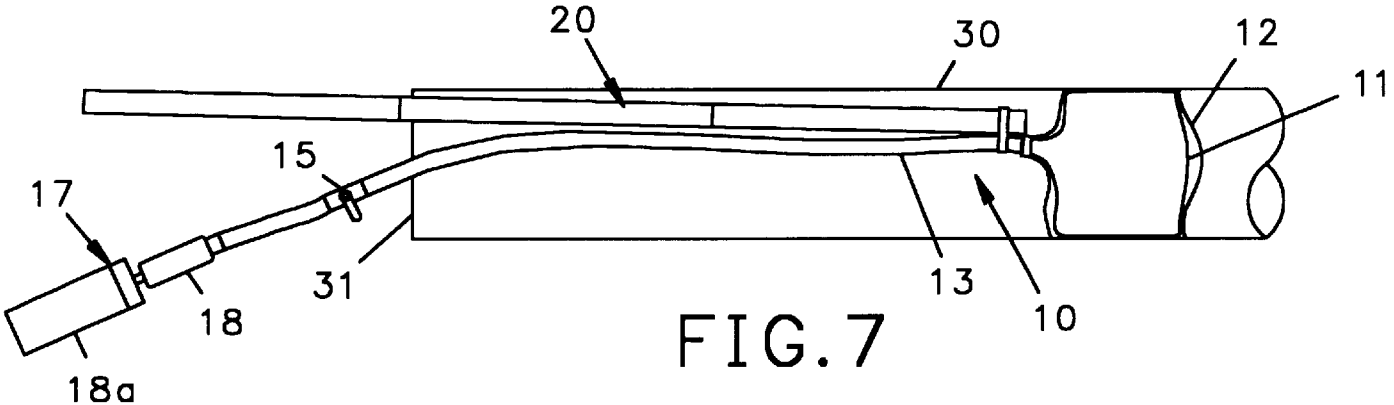
FIG. 7 is a front elevational view of a circular HVAC duct having the portable duct cleaning apparatus of the invention positioned therein with the bladder thereof shown in expanded position.
Figure 9:
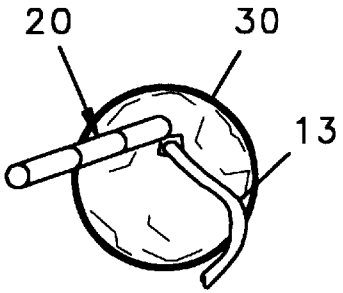
FIG. 9 is a cross-sectional view of a circular duct showing the expansible bladder showing the portable duct cleaning apparatus of the present invention completely filling the cross section of the duct.
Figure 8:
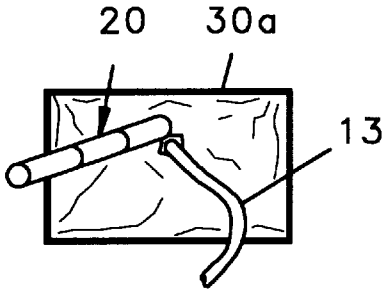
FIG. 8 is a cross-sectional view of a rectangular HVAC duct showing the duct cleaning apparatus of the invention positioned therein with the bladder in expanded position.

As shown most clearly in FIGS. 3, 4 and 5, traditional cleaning materials such as sponges, brushes and scrub pads may be integrally formed with the outside surface of the bladder 11 to provide outer cleaning surfaces such as sponge 24 as shown in FIG. 6, bristle brushes 25 as shown in FIG. 7 and scrub filaments 26 as shown in FIG. 8. The construction of the sponge material 24, the brushes 25 or the scrub filaments 26 may be made such that the expansion of the bladder 11, 11*a*–*c* is accomplished without negatively affecting the usefulness of the scrubbing material positioned on the outside of the bladder.

A portable HVAC duct cleaning apparatus has been shown and described that is simpler and more easily portable in construction than heretofore known duct cleaning apparatus for providing superior cleaning capabilities in connection with ridding the interior surfaces of HVAC ducts of dirt, grime, dust, etc. that may adversely affect occupants of a residence, office or factory in which the duct work is positioned.

While one embodiment and three modifications of the present invention have been shown and described, it will be apparent to those skilled in the art that many changes and modifications may be made without departing from the true spirit and scope of the present invention. It is the intent of the appended claims to cover all such changes and modifications which fall within the true spirit and scope of the invention.

What is claimed:

1. A portable inflatable heating, ventilating and air conditioning (HVAC) duct cleaning apparatus comprising:

bladder means made of resilient material for expanding and contracting the size there of, said bladder means having an opening thereon for moving air in and out therethrough;

an elongate flexible hose in communication at one end thereof with said opening on said bladder means, air pump means in communication at an opposing end of said elongate flexible hose for supplying air under low positive pressure to said bladder means when expanding same;

manually operable valve means positioned between said air pump means and said bladder for preventing the escape of air from said bladder means as desired; and direction stabilizing means including an extensible rod connected to said apparatus adjacent a joinder of said bladder means and said elongate flexible hose, for aiding in positioning said bladder means a substantial distance from any opening in any HVAC duct in which said apparatus is positioned.

2. The portable inflatable HVAC duct cleaning apparatus as defined in claim 1 wherein said direction stabilizing means further comprises:

an elongate multiple coil spring wire or routing coil positioned inside said elongate flexible hose for reinforcing said hose for reinforcing said hose.

3. The portable inflatable HVAC duct cleaning apparatus as defined in claim 1 wherein said direction stabilizing means further include:

a flexible coil extending from inside said hose to inside said bladder means for keeping said bladder means from folding backward on itself.

4. The portable inflatable HVAC duct cleaning apparatus as defined in claim 1 wherein said bladder means includes, a balloon shape body of resilient material and a removable cloth covering over said body, said covering being wettable by a liquid cleaning solution.

5. The portable inflatable HVAC duct cleaning apparatus as defined in claim 1 wherein said bladder means include, a balloon shape body of resilient material including a resilient sponge exterior adapted for retaining a cleaning liquid solution thereon.

6. The portable inflatable HVAC duct cleaning apparatus as defined in claim 1 wherein said bladder means include, a balloon shape body of resilient material including a fibrous cleaning pad exterior.

7. The portable inflatable HVAC duct cleaning apparatus as defined in claim 1 wherein said bladder means include, a balloon shape body of resilient material including bristles extending from the exterior thereof.

8. The portable inflatable HVAC duct cleaning apparatus defined in claim 1 wherein said air pump means comprises, a portable manually operable air pump.

9. A portable inflatable heating, ventilating and air conditioning (HVAC) duct cleaning apparatus comprises:

a bladder made of resilient material and including an opening adjacent one end thereof for moving air in and out therethrough to expand and contract the size of the bladder;

an elongate, flexible hose connected at one end thereof to the opening on the bladder;

a manually operated air pump mounted in fluid communication at an opposing end of the elongate flexible hose for supplying air under low pressure to the bladder for expanding same;

a manually operable valve positioned between the air pump and the bladder in the elongate flexible hose for preventing the escape of air from the bladder after the pump has been utilized to expand the bladder;

a tube positioned within the one end of the elongate flexible hose and extends through the small opening in the bladder to the inside thereof to prevent the bladder from folding backwards while positioning the bladder in any HVAC duct; and direction stabilizing means said including an extensible rod connected to apparatus adjacent a joinder of said bladder means and said elongate flexible hose for aiding and positioning the bladder a substantial distance from any opening in any HVAC duct in which the apparatus is positioned.

* * * * *